United States Patent [19]

Grogan

[11] Patent Number: 4,946,074

[45] Date of Patent: Aug. 7, 1990

[54] TAMPER EVIDENT MANUALLY ACTUATED PUMP SPRAYER

[75] Inventor: Richard P. Grogan, Downey, Calif.

[73] Assignee: Calmar, Inc., Watchung, N.J.

[21] Appl. No.: 366,633

[22] Filed: Jun. 15, 1989

[51] Int. Cl.[5] ..... B67D 5/40

[52] U.S. Cl. ..... 222/153; 222/384; 222/402

[58] Field of Search ..... 222/153, 541, 384, 402; 239/333

[56] References Cited

U.S. PATENT DOCUMENTS

| | | | |
|---|---|---|---|
| 3,837,537 | 9/1974 | Baldwin | 222/153 |
| 4,346,821 | 8/1982 | Wesner et al. | 222/153 |
| 4,424,919 | 1/1984 | Knox et al. | 222/153 |
| 4,441,633 | 4/1984 | Bennett | 222/153 |
| 4,506,805 | 3/1985 | Marcon | 222/153 |
| 4,852,770 | 8/1989 | Sledge et al. | 222/153 |

*Primary Examiner*—Joseph J. Rolla
*Assistant Examiner*—Gregory L. Huson
*Attorney, Agent, or Firm*—Watson, Cole, Grindle & Watson

[57] ABSTRACT

A tamper evident manually actuated pump sprayer includes a locking device which, according to one embodiment, extends between the trigger actuator and a confronting portion of the pump body and abuts against a trigger flange. In another embodiment, the device engages the underside of the trigger and snap fits into the sprayer nozzle cap located adjacent the trigger.

9 Claims, 1 Drawing Sheet

TAMPER EVIDENT MANUALLY ACTUATED PUMP SPRAYER

BACKGROUND OF THE INVENTION

This invention relates generally to a pump sprayer having a hinged trigger lever intended to be squeezed upon application of a substantially horizontal finger force applied thereto for reciprocating a pump piston to dispense product from a container to which the dispenser is connected. More particularly, a locking element is applied to the trigger for immobilizing it against actuation to render the dispenser tamper proof in an inoperative lock position of the sprayer. The locking element is removable for unlocking the sprayer to an operative position.

U.S. Pat. Nos. 4,373,644 and 4,441,633 disclose a locking device for a child resistant trigger pump. The device is snap fitted to a container closure on the body, and an arm on the device is disposed in alignment with the trigger for locking the pump by preventing trigger actuation. Rotation of the locking device about its central axis moves its arm out of alignment with the trigger and places the sprayer in an unlocked position to permit trigger actuation.

Rotation of the device into the locked position renders the pump sprayer child resistant, but not tamper evident in that rotation of the device into locked and unlocked positions is incapable of evidencing tampering with the sprayer especially while shelved or displayed at the point of sale of the product.

And trigger sprayers without a tamperproof device can be actuated while shelved or stored spraying liquid on a passerby or on the floor, thereby creating a hazardous condition.

SUMMARY OF THE INVENTION

It is therefore an object of the present invention to provide a manually actuated trigger sprayer having a tamper evident device which locks the trigger in an inoperative position of the sprayer and which can be manually removed to allow trigger operation for its intended use. Any danger in spraying a target other than that for which the sprayer is intended is avoided, and any surreptitious removal of the device while stored or displayed will immediately evidence tampering.

As one embodiment of the invention, the device comprises a substantially cross-shaped element having a flat portion extending between and bearing against the lever and a portion of the pump body which confronts the lever. Transversely extending wings extend from opposite sides of the flat portion, one wing bearing against a flange on the trigger, and the other wing facilitating manual removal of the locking element. The flat portion may have a weakened section adjacent one or both wings to facilitate bending or snapping apart of the device upon tampering or upon intentional use as the trigger is squeezed.

In another embodiment, the device has a portion snapped fitted to the nozzle provided for the pump sprayer, and has a connected portion engaging an underside of the trigger for locking it against actuation. A pull tab on the device facilitates manual removal.

Other objects, advantages and other features of the invention will become more apparent from the following detailed description of the invention when taken in conjunction with the accompanying drawings.

DETAILED DESCRIPTION OF THE INVENTION

Figure 1:
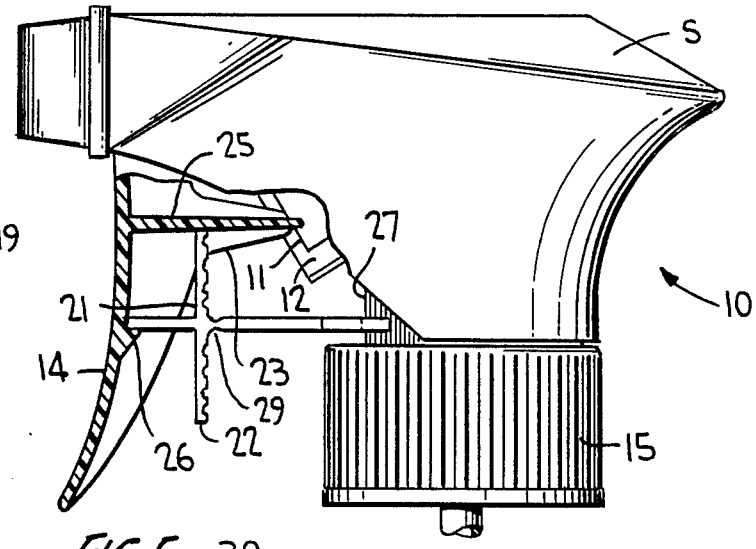
FIG. 1 is a side elevational view of a trigger sprayer, shown partly in section, incorporating the locking device according to one embodiment of the invention.

Turning now to the drawings wherein like reference characters refer to like and corresponding parts throughout the several views, a known trigger sprayer is generally designated 10 in FIG. 1 as comprising a pump body covered by a shroud S, with only those elements of the pump body essential in describing the invention being illustrated in the interest of clarity. The pump body includes a pump piston 11 operating in a pump cylinder 12 for spraying a liquid product through a discharge 13 (FIG. 3) in the normal manner upon actuation of a trigger lever 14 hingedly connected to the pump body in a known manner. A closure cap 15 on the pump body engages the neck of a container 16 (FIG. 3), and a dip tube 17 extends from the pump body into the container such that liquid is sprayed as the pump is actuated upon reciprocation of the piston upon application of a substantially horizontal finger force applied to the trigger, as known in this art.

Figure 2:
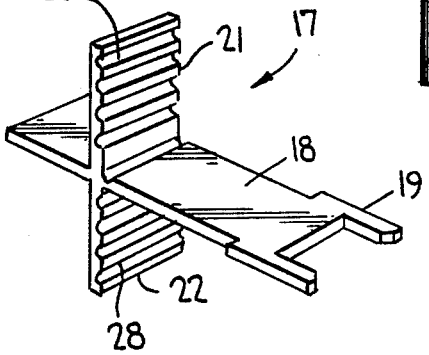
FIG. 2 is a perspective view of the locking device of FIG. 1.

The trigger sprayer is rendered inoperative tamper evident by the provision of a locking device 17 most clearly illustrated in FIG. 2 as comprising a substantially cross-shaped element having a central flat portion 18 with a clawed end 19. Opposing wings 21, 22 transversely extend from central portion 18.

The trigger has a pair of spaced tongues 23, 24 (only one of which is shown in FIG. 1) adapted to bear against the outer end of pump piston 11. An inner flange 25 transversely extends between the tongues and projects slightly into the pump piston. Also, the trigger may be provided with an inwardly extending detent 26.

Locking device 17 is assembled in place by extending its central portion between and bearing against the underside of the trigger lever and a confronting portion 27 of the pump body located just above the closure cap. The claws at end 19 are sized to span opposing sides of body portion 27. In the position shown in FIG. 1, one of the wings, such as 21, bears against the underside of flange 25, and the other wing 22 functions as a pull tab.

It can be seen that the three-point bearing engagement of the locking device against elements of the sprayer as aforedescribed locks the trigger against actuation normally effected by moving the trigger upon application of a finger force applied thereto in the direction toward the pump body.

The locking device may be inserted in place with either wing 21 bearing against the underside of flange 25 as shown, or wing 22 upstanding and bearing against the underside of flange 25. In whichever position, the other wing, such as 22, extends downwardly and functions as a pull tab to effect manual removal of the locking device prior to pumping. Detent 26 has a sloping outer surface to facilitate easy snap fit assembly of the locking device into its FIG. 1 position.

The wings may be provided with grooved or roughened inner surfaces 28 to enhance the gripping action applied to the pull tab. And central portion 18 may be provided with a weakened section in the form of a groove 29 on one or both sides thereof adjacent the wings.

The trigger is locked against actuation unless removed to facilitate spraying an intended target for which the sprayer is designed. If the locking device is prematurely removed while shelved or stored, tampering is immediately evidenced. Upon removal, the device will snap or bend along weakening 29 upon pulling on tab 22 causing portion 18 to bend or snap along its groove 29 allowing the locking device to simply fall away from the sprayer.

Figure 3:
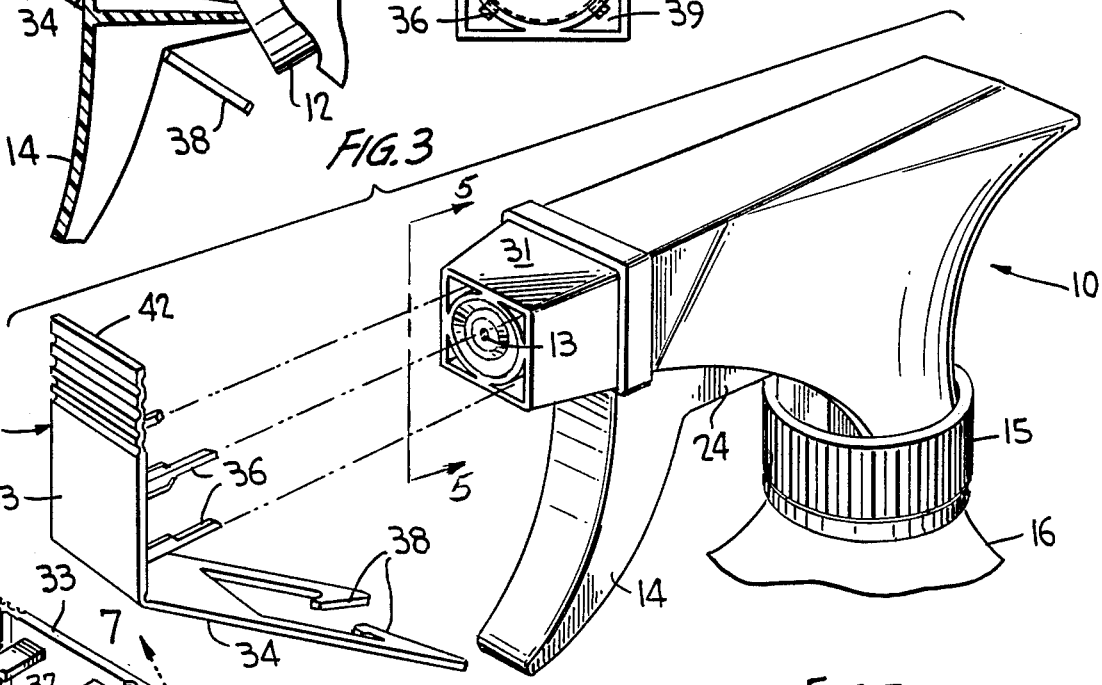
FIG. 3 is a perspective view of a trigger sprayer and a locking device shown in expanded view according to another embodiment of the invention.
Figure 6:
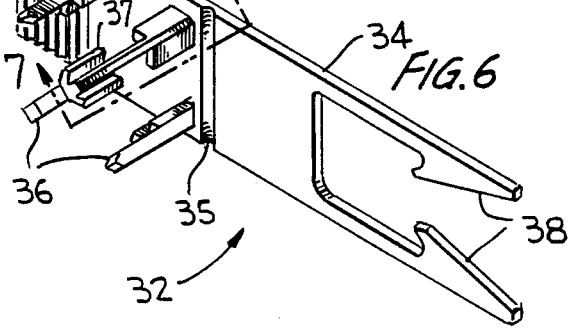
FIG. 6 is a perspective view of the locking element of FIG. 3 in its unbent condition.
Figure 7:
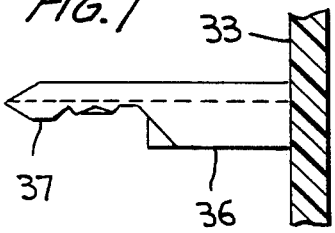
FIG. 7 is a view of one of the locking tongues on the locking element taken substantially along the line 7—7 of FIG. 6.

Another embodiment of the invention is illustrated in FIGS. 3–7, the same pump sprayer 10 being shown in FIG. 3 as having a nozzle cap 31 containing the discharge orifice. Locking device 32 in the form of a strap has a first portion 33 and a second portion 34 interconnected along a fold line 35. Projections 36 extend from one side of portion 33 with at least one projection having a snap catch 37 most clearly shown in FIGS. 6 and 7. Portion 34 of the locking device has claws 38 at one end.

Figure 4:
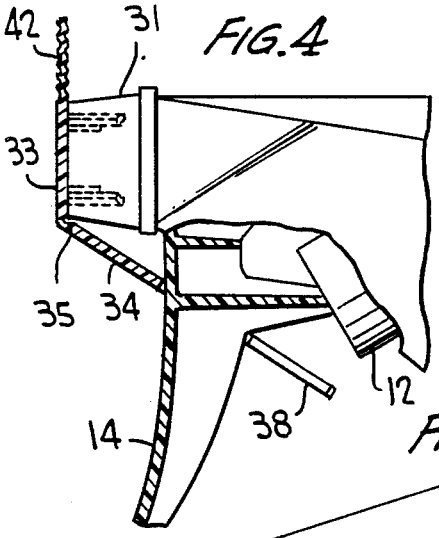
FIG. 4 is a side elevational view of the FIG. 3 sprayer and locking device, partly in section, with the device shown in its locked position.
Figure 5:
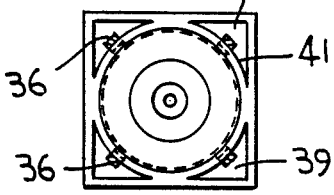
FIG. 5 is a front elevational view of the sprayer nozzle taken substantially along the line 5—5 of FIG. 3.

In use, the locking device is assembled to the sprayer by engaging claws 38 with the underside of trigger lever 14, and inserting projections 36 into openings 39 of the nozzle (FIG. 5). The snap catches on the projections engage an internal shoulder 41 provided in a nozzle for snap-fitting the locking device in place in its locked position shown in FIG. 4. A pull tab 42 extends from first portion 33 and may be roughened or grooved as shown for manual gripping.

In the FIG. 4 lock position, the trigger is immobilized against pulling thus locking the sprayer against actuation. The spraying of a target other than that for which the sprayer is designed is prevented. And tampering is evident if the locking device is removed by pulling on tab 42 or by disengaging claws 38 from the trigger. Legitimate use is facilitated by simply pulling on the tab to remove the device by unsnapping the projections from the nozzle allowing the locking device to simply fall away from the sprayer. The projections may be suitably fragile so that upon pulling on the tab they will remain within the nozzle cap without interference with intended use.

From the foregoing it can be seen that a locking device is provided for preventing target spray at the point of sale and for rendering the trigger operated sprayer tamper evident by locking the trigger against actuation and by alerting the user to any tampering or attempted tampering. The device may be manually removed with ease to facilitate authorized use. Moreover, the device is of simple construction making it easy to use and produce, is economical yet highly efficient. The device according to either embodiment may be simply made one piece, and is easy to assemble.

Obviously, many other modifications and variations of the present invention are made possible in the light of the above teachings. It is therefore to be understood that within the scope of the appended claims the invention may be practiced otherwise than as specifically described.

What is claimed is:

1. A tamper evident manually actuated pump sprayer having a pivotable pump actuator movable upon application of a substantially horizontal finger force applied thereto, the sprayer having a pump body and a reciprocable pump piston, and the actuator comprising a lever having tongue means bearing against the piston, a locking device in combination comprising a flat element extending between and bearing against said lever and a portion of the pump body which confronts said lever, said element having at least one wing transversely extending from one side thereof and bearing against said tongue means, and said element having a weakened section adjacent said wing, whereby said device wedges the lever for locking the sprayer in an inoperative position, said device being manually removable for unlocking the sprayer to an operative position upon application of external force to said element causing said element to at least bend along said weakened portion thus indicating said locking device has been removed.

2. The device according to claim 1, wherein said element has a clawed end for retaining said device against said portion of the pump body.

3. The device according to claim 1, wherein the lever has a retaining lug against which an end of said element bears in said inoperative position.

4. The device according to claim 1, wherein said element has another wing transversely extending from a side thereof opposite said one side for facilitating manual removal of said device.

5. A tamper evident manually actuated pump sprayer having a pivotable pump actuator movable upon application of a substantially horizontal finger force applied thereto, the actuator comprising a lever, and the sprayer having a nozzle cap adjacent said lever, said nozzle cap containing a discharge orifice, a locking device in combination comprising a strap in engagement at one end with the lever and releasably connected at its other end to the nozzle cap for locking the lever into an inoperative position against movement, said device being manually removable by disengagement of said one end from said nozzle cap for thereby unlocking the sprayer to an operative position thus indicating said locking device has been removed.

6. The device according to claim 5, wherein said strap has a hooked end engaging the underside of the lever.

7. The device according to claim 5, wherein said strap has at least one projection, and cooperating catch means on said projector and the nozzle cap for releasably connecting said strap to the cap.

8. The device according to claim 5, wherein said strap has a pull tab to facilitate manual removal of said device.

9. The device according to claim 5, wherein said strap has a foldline to permit bending adjacent the nozzle cap.

* * * * *